US006123448A

United States Patent [19]

Becker et al.

[11] Patent Number: 6,123,448

[45] Date of Patent: Sep. 26, 2000

[54] AGITATOR FOR FIXING AND/OR CONVEYING AGGRESSIVE LIQUIDS AND/OR LIQUIDS CONTAINING SOLIDS OR FIBERS

[75] Inventors: Klaus Becker, Berg.-Gladbach; Manfred Dirla, Overath; Wilfried Wasser, Seelscheid; Hans-Peter Fassbender, Lindler, all of Germany

[73] Assignee: ABS Pump Cent4r GmbH, Lohmar, Germany

[21] Appl. No.: 08/776,926

[22] PCT Filed: Aug. 9, 1995

[86] PCT No.: PCT/DE95/01042

§ 371 Date: Feb. 11, 1997

§ 102(e) Date: Feb. 11, 1997

[87] PCT Pub. No.: WO96/04984

PCT Pub. Date: Feb. 22, 1996

[30] Foreign Application Priority Data

Aug. 12, 1994 [DE] Germany ..... 44 28 603

[51] Int. Cl.[7] ..... B01F 15/00

[52] U.S. Cl. ..... 366/270; 277/572; 415/174.3; 416/146 A; 416/174; 416/247 A

[58] Field of Search ..... 366/63, 102, 262–265, 366/270, 330.1–330.7, 331, 342, 343, 349; 277/560, 572, 586; 440/71–73, 76, 78; 415/174.3; 416/174, 247 A, 146 A, 146 B, 244 B

[56] References Cited

U.S. PATENT DOCUMENTS

| | | | |
|---|---|---|---|
| 4,021,143 | 5/1977 | May | 416/174 |
| 4,911,663 | 3/1990 | Meier | 440/73 X |
| 5,490,731 | 2/1996 | Scharf et al. | 277/572 X |

FOREIGN PATENT DOCUMENTS

| | | | |
|---|---|---|---|
| 749945 | 8/1933 | France | 416/247 A |

*Primary Examiner*—Charles E. Cooley
*Attorney, Agent, or Firm*—Diller, Ramik & Wight, PC

[57] ABSTRACT

An agitator includes a drive motor having a shaft projecting through an axial end of a housing and having connected thereto a propeller boss. The propeller boss and housing define a circumferential gap spanned by a circumferentially extending radially outermost gap covering and sealing portion of a deflector ring. The deflector ring includes a radially innermost ring mounting portion located in the circumferential gap. The deflector ring is preferably made of elastomeric material and an outermost circumferential surface of the deflector ring is exteriorly convexly curved in the form of an aerofoil converging axially toward ends of sealing lips of the deflector ring gap covering and sealing portion.

4 Claims, 2 Drawing Sheets

7
13
12
15
9
10
11
2
14
8
6
5
1
4
3
M

AGITATOR FOR FIXING AND/OR CONVEYING AGGRESSIVE LIQUIDS AND/OR LIQUIDS CONTAINING SOLIDS OR FIBERS

BACKGROUND OF THE INVENTION

The invention concerns an agitator for the mixing and/or conveying of aggressive liquids and/or liquids containing solids or fibers, consisting of a drive motor which is encapsulated by a housing and seals so as to be liquid-tight, on the central drive shaft of which a propeller boss is located, the largest diameter of which is roughly equal to the diameter of the housing, where an elastic deflector ring which overlaps the gap between propeller boss and housing is provided on the housing.

This class of drive, as known from U.S. Pat. No. 5,007,867 or EP-A-0.252.037, for example, is also used as agitators, particularly in sewage engineering, for mixing liquids containing solids or fibers, in order to prevent the solids settling on the bottom of a tank or container, for example. To this end, the agitators are immersed in the liquid to be mixed and fastened below the liquid level. The liquids to be mixed can, to a limited extent, also be conveyed with the help of the agitators if an appropriate piece of piping is installed upstream of the propeller.

The usually dome-shaped design of the propeller boss, the largest diameter of which is roughly equal to the diameter of the housing, is intended to achieve the most favorable flow conditions possible, in order to keep the formation of eddies relatively low and achieve an optimum mixing effect at a high level of efficiency.

According to the prior art, in order to avoid solid or fibrous materials being drawn into the gap between the housing and the propeller boss in the known drives or agitators, a deflector ring is placed over this gap, but does not lie against the propeller boss to form a seal.

In addition to the penetration of solid materials, there is also the problem, when handling aggressive liquids, that acids or alkalis with relatively high flow rates pass through the gap into the internal cavity of the propeller boss and act on the drive shaft or the floating ring seals surrounding the drive shaft, which can cause damage or leaks. In order to prevent the penetration of such aggressive liquids, attempts have thus been made to build up excess pressure with the help of a rinsing liquid which is fed into the internal cavity of the propeller boss so that the aggressive liquids can no longer enter or are diluted. However, as this liquid escapes through the gap, relatively large quantities of rinsing liquid must be used.

SUMMARY OF THE INVENTION

The invention is based on the task of creating an agitator which prevents penetration of the gap between housing and propeller boss by solid or fibrous materials in a simple manner or minimises the necessary quantity of rinsing liquid when using a rinsing device.

According to the invention, this task is solved by the area of the deflector ring which overlaps the propeller boss being designed as an all-round tongue which lies on the propeller boss or displaying an all-round sealing lip which lies on the propeller boss.

The elastic deflector ring is fastened on the housing and seals this by overlapping it with one lateral area, while the opposite lateral area lies on the propeller boss to form a seal, meaning that the gap between housing and propeller boss is effectively covered in a simple manner. The elastic design even ensures a deflecting effect as regards the gap if the propeller boss displays certain tolerances or runs eccentrically.

In order to ensure that the deflector ring sits tightly on the housing, it is preferably provided with internal, all-round grooves or projections which can be pressed into corresponding projections or grooves on the head of the housing. In this way, worn deflector rings can be very easily replaced, as they can be expanded slightly owing to their elastic design and, for example, pushed backwards over the housing and removed or fitted.

The outer peripheral surface of the deflector ring is preferably designed in the manner of an aerofoil so that the flow in the vicinity of the deflector ring caused by the propeller effect is accelerated towards the propeller and fibers or solid particles are drawn away from the gap or the area of the deflector ring in this way. These components can thus no longer be drawn into the gap, even if the deflector ring area overlapping the propeller boss is worn and no longer lies on the peripheral surface of the propeller boss.

At the same time, the design of the deflector ring in the manner of an aerofoil ensures undisturbed, turbulence-free streamlined flow of the liquid, meaning that it can separate in the rear area of the deflector ring without reflux and thus with little loss. The undisturbed, low-turbulence flow reduces the energy consumption of the agitator while retaining the mixing capacity.

A good sealing effect of the deflector ring is also achieved if the area overlapping the propeller boss is designed as a relatively thin all-round lip, the underside of which lies on the peripheral surface of the propeller boss. This lip can also display an inward-pointing, additional all-round lip making linear contact.

If the penetration of liquid into the internal cavity of the propeller boss is to be prevented as far as possible, particularly during use in aggressive liquids, and the aforementioned rinsing devices are provided for this reason, these can be easily combined with the deflector ring. To this end, an opening is provided in the vicinity of the gap, though which the connecting branch of a feed line for the rinsing liquid is inserted. A constant supply of rinsing liquid to the internal cavity is enabled in this way. The elastic design of the deflector ring minimises the loss of rising liquid if the excess pressure of the rising liquid is correspondingly low, meaning that the installed pumps or storage tanks for the rising liquid can be of considerably smaller design.

The deflector ring is preferably made of an acid and alkali-resistant elastomeric material, in particular of acrylonitrile butadiene rubber or fluorinated rubber, so that ageing processes are largely avoided and a long service life is guaranteed.

BRIEF DESCRIPTION OF THE DRAWINGS

An example of the invention is illustrated in the drawings and described in detail below on the basis of the drawings. The drawings show the following.

DESCRIPTION OF THE PREFERRED EMBODIMENT

Figure 1:
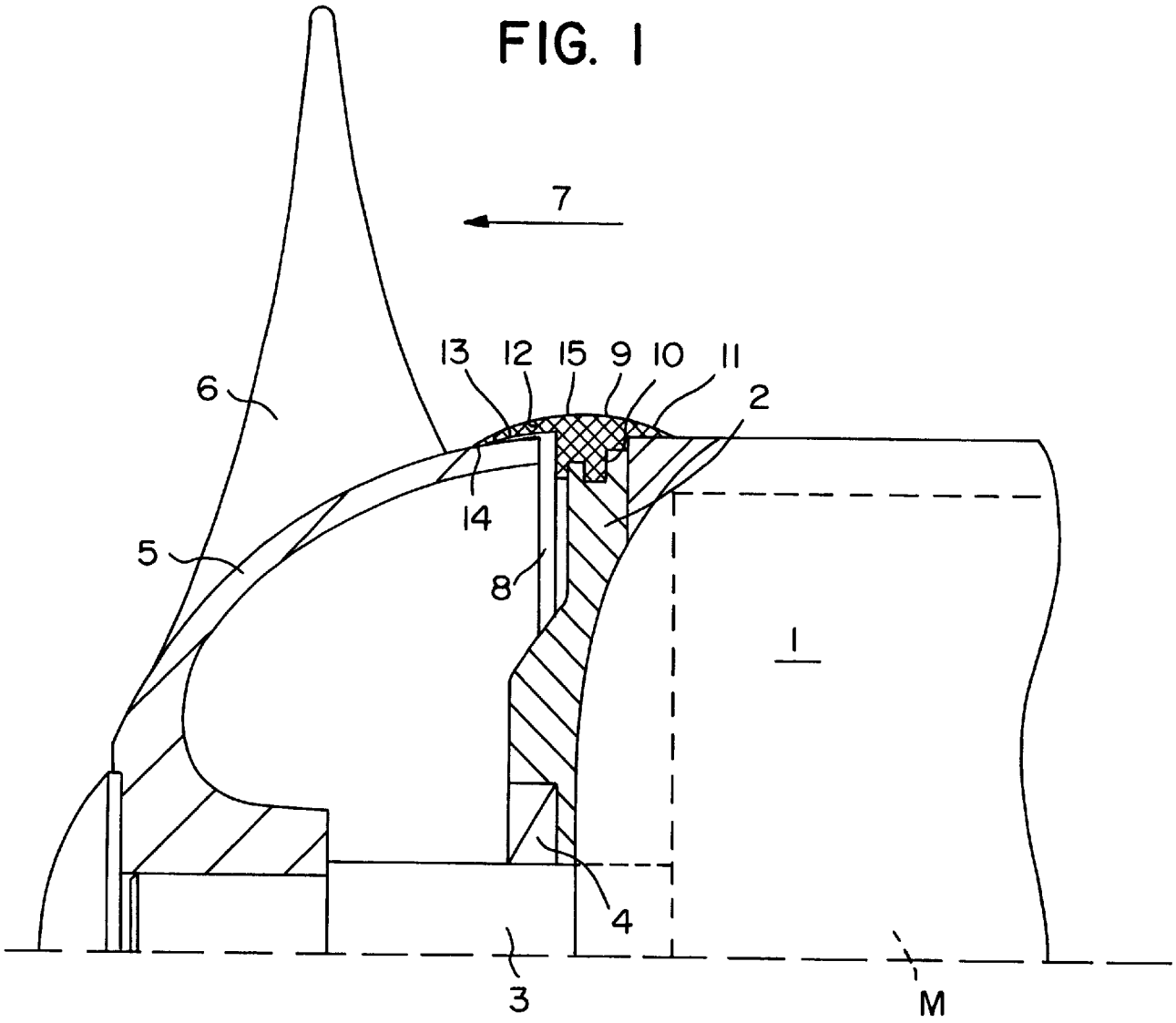
FIG. 1 A schematic partial section through an agitator with a deflector ring inserted in the region of the gap between propeller boss and housing and FIG. 2 A section through a deflector ring with a modified sealing lip.

The agitator schematically illustrated in a partial section in FIG. 1 consists of a roughly circular housing 1 with an endmounted flange 2, which is penetrated in the middle by a drive shaft 3, which is connected to an electric motor situated in a liquid-proof position in housing 1. A shaft seal 4, inserted in end-mounted flange 2, serves to seal drive shaft 3.

A roughly dome-shaped propeller boss 5, bearing a number of propeller blades 6 which generate a flow in the direction of arrow 7 when propeller boss 5 rotates, is fitted on drive shaft 3 in such a way that it cannot be turned.

A gap 8, which is covered by a deflector ring 9, is situated between end-mounted flange 2 and propeller boss 5. The deflector ring is fitted in a groove 10 provided in the outer peripheral surface of end-mounted flange 2. Its right side 11 overlaps the end region of housing 1 and lies on the outer wall of the housing, while its left side 12 overlaps the outer peripheral surface of propeller boss 5.

Left side 12 of deflector ring 9 displays a tongue 13, the inner sealing surface 14 of which lies on propeller boss 5.

Outer peripheral surface 15 of deflector ring 9 is of convex design in the manner of an aerofoil, meaning that the flow is accelerated in the conveying direction in the region of left side 12 and tongue 13.

Figure 2:
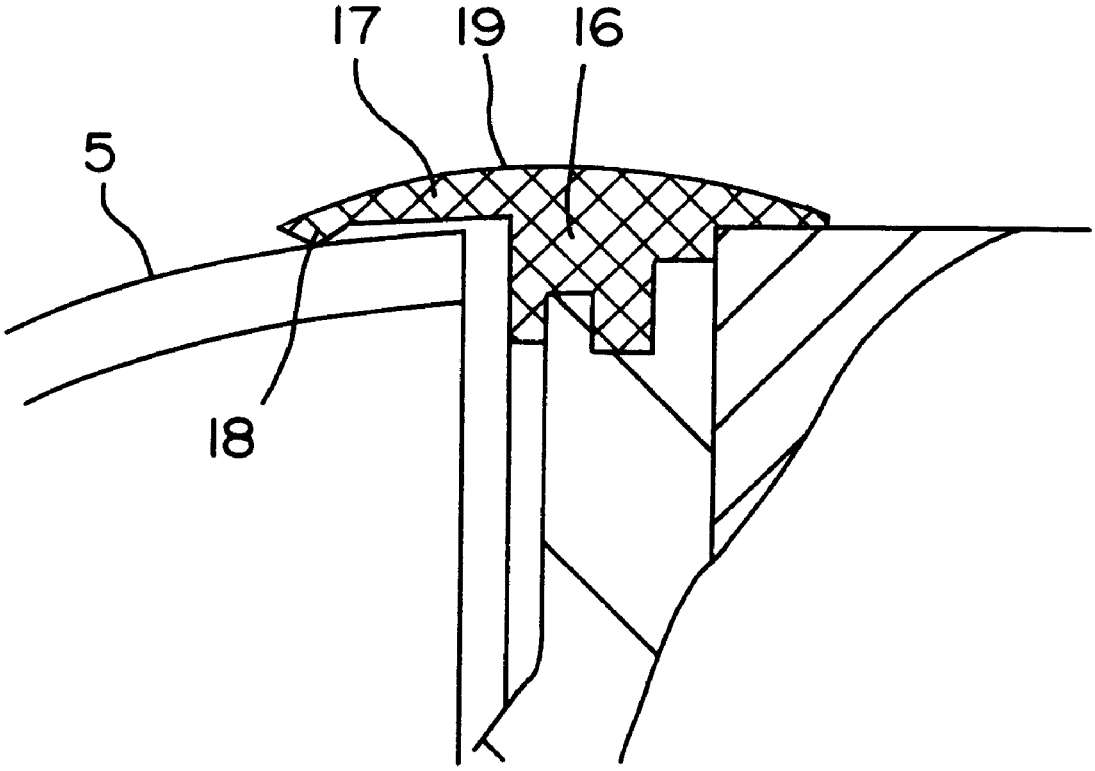

The left side of deflector ring 16 illustrated in FIG. 2 is formed by a tongue 17 which in turn overlaps propeller boss 5, making linear contact with it with a sealing lip 18. Deflector ring 16 also displays a convex surface 19 in the manner of an aerofoil.

We claim:

1. An agitator for mixing and/or conveying aggressive liquids and/or liquids containing solids or fibers comprising a drive motor housed by a housing, a drive shaft of said drive motor projecting beyond an axial end of said housing, a propeller boss carried by said drive shaft and defining a circumferential gap with said housing axial end, said propeller boss and housing having adjacent outer peripheral surfaces of substantially similar diameters, a deflector ring defined by a circumferentially extending radially innermost ring mounting portion and a circumferentially extending radially outermost gap covering and sealing portion, said ring mounting portion being located in said circumferential gap, said covering and sealing portion spanning said gap and having oppositely axially directed sealing lips, one of said sealing lips being in sealing contacting relationship with said housing outer peripheral surface, another of said sealing lips being in sealing contacting relationship with said boss outer peripheral surface, said deflector ring being made of elastomeric material, and an outermost circumferential surface of said deflector ring being exteriorly convexly curved in the form of an aerofoil converging axially toward ends of each of said sealing lips.

2. The agitator as defined in claim 1 including a circumferential groove in the area of said circumferential gap, and said ring mounting portion being seated in said circumferential groove.

3. The agitator as defined in claim 1 including a mounting flange carried by said housing, said mounting flange having a circumferential groove in the area of said circumferential gap, and said ring mounting portion being seated in said mounting flange circumferential groove.

4. The agitator as defined in claim 1 including a mounting flange carried by said housing substantially within said circumferential gap, said mounting flange having a circumferential groove, and said ring mounting portion being seated in said mounting flange circumferential groove.

* * * * *